US010520201B2

(12) United States Patent
Ivanovic et al.

(10) Patent No.: US 10,520,201 B2
(45) Date of Patent: Dec. 31, 2019

(54) GLASS PACKAGE AND FRAMEWORK FOR AN OVEN DOOR OF A COOKING OVEN

(71) Applicant: Electrolux Appliances Aktiebolag, Stockholm (SE)

(72) Inventors: Branko Ivanovic, Rothenburg ob der Tauber (DE); Dietmar Hildner, Rothenburg ob der Tauber (DE)

(73) Assignee: Electrolux Appliances Aktiebolag, Stockholm (SE)

( * ) Notice: Subject to any disclaimer, the term of this patent is extended or adjusted under 35 U.S.C. 154(b) by 403 days.

(21) Appl. No.: 15/325,776

(22) PCT Filed: Apr. 30, 2015

(86) PCT No.: PCT/EP2015/059549
§ 371 (c)(1),
(2) Date: Jan. 12, 2017

(87) PCT Pub. No.: WO2016/034293
PCT Pub. Date: Mar. 10, 2016

(65) Prior Publication Data

US 2017/0159942 A1 Jun. 8, 2017

(30) Foreign Application Priority Data

Sep. 5, 2014 (EP) ..... 14183706

(51) Int. Cl.
*F24C 15/04* (2006.01)

(52) U.S. Cl.
CPC ..... *F24C 15/04* (2013.01); *F24C 15/045* (2013.01)

(58) Field of Classification Search
CPC .. E06B 1/6053; E06B 3/66347; A47F 3/0434; F24C 15/04
See application file for complete search history.

(56) References Cited

U.S. PATENT DOCUMENTS 2,003,982 A * 6/1935 Swanson ..... E06B 3/28 52/202
2,145,930 A * 2/1939 Herron ..... B32B 17/10055 156/107

(Continued)

FOREIGN PATENT DOCUMENTS

DE 10143923 A1 3/2003
DE 10143920 A1 * 4/2003 ..... F24C 15/045

(Continued)

OTHER PUBLICATIONS

DE 10143920 A1—English machine translation.*

(Continued)

*Primary Examiner* — Jorge A Pereiro
(74) *Attorney, Agent, or Firm* — Pearne & Gordon LLP

(57) ABSTRACT

The present invention relates to glass package (10) for an oven door of a cooking oven. The glass package (10) includes an inner glass pane (12) and at least one further glass pane (14, 16), wherein the inner glass pane (12) is provided for an arrangement towards to an oven cavity (46) in an assembled and a closed state of the oven door, while the at least one further glass pane (14, 16) is provided for an arrangement opposite to the oven cavity (46) in the assembled and closed state of the said door. The glass package (10) includes connecting means (18, 20, 28) for a permanent connection between the inner glass pane (12) and the at least one further glass pane (14, 16). The inner glass pane (12) and the at least one further glass pane (14, 16) are arranged plane-parallel to each other. An intermediate space is formed between two adjacent glass panes (12, 14, 16). At least one slot (19) and/or channel (30) enclose or encloses at least partially the circumferential sides of the glass package (10) along a circumferential direction. The width and height of the inner glass pane (12) are bigger than the width and height, respectively, of the at least one further glass pane (Continued)

Figure 1:
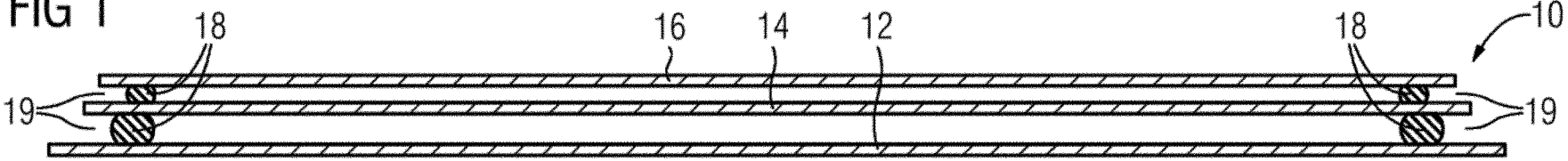

(14, 16) and of any further component of the glass package (10), wherein the widths and heights of the glass panes (12, 14, 16) relate to the large-area sides of said glass panes (12, 14, 16). Further, the present invention relates to a corresponding framework (32) 25 for an oven door of a cooking oven. Moreover, the present invention relates to an oven door including the glass package (10) and the framework (32). Additionally, the present invention relates to a method for assembling an oven door for a cooking oven.

9 Claims, 5 Drawing Sheets

(56) References Cited

U.S. PATENT DOCUMENTS 2,177,001 A * 10/1939 Owen ..... E06B 3/28 52/203
2,587,527 A 2/1952 Reeves
2,701,041 A * 2/1955 Toth ..... E06B 3/64 52/204.593
2,750,637 A * 6/1956 Browne ..... E06B 3/66328 428/34
3,021,243 A * 2/1962 Bethge ..... C03C 27/048 156/109
3,045,297 A * 7/1962 Ljungdahl ..... C03C 27/08 428/184
3,241,547 A 3/1966 Hirsch
3,460,303 A * 8/1969 Algrain ..... B44C 5/08 156/63
3,686,795 A * 8/1972 La Barge ..... E06B 3/308 49/345
3,795,076 A * 3/1974 Anderson ..... E06B 1/342 49/192
3,824,753 A * 7/1974 Anderson ..... E06B 3/28 49/62
3,957,406 A * 5/1976 Battersby ..... B29C 70/763 425/87
3,971,178 A * 7/1976 Mazzoni ..... E06B 3/5418 52/172
4,023,554 A 5/1977 Katona
4,089,143 A * 5/1978 La Pietra ..... E06B 3/28 52/172
4,198,254 A * 4/1980 Laroche ..... C03C 27/10 156/107
4,206,338 A 6/1980 Katona
4,364,209 A * 12/1982 Gebhard ..... E06B 3/5418 52/204.597
4,950,344 A * 8/1990 Glover ..... E06B 3/66342 156/104
5,107,655 A * 4/1992 Lindgren ..... A47F 3/043 52/786.1
5,255,473 A * 10/1993 Kaspar ..... A47F 3/043 49/501
5,260,112 A * 11/1993 Grether ..... E06B 3/66319 428/192
5,732,517 A * 3/1998 Milikovsky ..... E06B 3/6715 428/34
5,950,398 A * 9/1999 Hubbard ..... E06B 3/645 49/463
6,135,130 A 10/2000 Martineau
6,351,923 B1 * 3/2002 Peterson ..... E06B 3/66314 52/745.16
7,763,334 B2 * 7/2010 Berkowitz ..... E06B 3/5418 428/34
8,595,994 B1 * 12/2013 Grommesh ..... E06B 3/66304 52/171.3
2002/0073645 A1 * 6/2002 Richardson ..... A47F 3/0434 52/786.11
2002/0189743 A1 * 12/2002 Hornung ..... E06B 3/24 156/109
2003/0084622 A1 * 5/2003 Hornung ..... E06B 3/24 52/172
2004/0123557 A1 * 7/2004 Hornung ..... E06B 3/24 52/786.13
2004/0159317 A1 8/2004 Walther et al.
2004/0211134 A1 * 10/2004 Glover ..... E06B 3/24 52/204.5
2005/0132662 A1 * 6/2005 Hornung ..... E06B 3/24 52/202
2006/0048468 A1 * 3/2006 Demars ..... E06B 3/66333 52/204.6
2007/0122572 A1 * 5/2007 Shibuya ..... C08L 23/22 428/34
2009/0139164 A1 * 6/2009 Prete ..... E06B 3/66347 52/204.593
2010/0011703 A1 * 1/2010 Seele ..... E06B 3/663 52/786.1
2014/0109499 A1 * 4/2014 Nieminen ..... E06B 3/66366 52/204.593
2015/0211290 A1 * 7/2015 Corley ..... E06B 3/5814 49/475.1
2015/0345208 A1 * 12/2015 Boulanger ..... E06B 3/6612 428/34
2017/0082297 A1 3/2017 Ivanovic et al.
2017/0159942 A1 6/2017 Ivanovic et al.
2017/0334540 A1 * 11/2017 Hanske ..... B64C 1/1492

FOREIGN PATENT DOCUMENTS

DE 10143920 A1 4/2003
DE 10143928 A1 5/2003
DE 10202144 A1 7/2003
DE 10243552 A1 4/2004
DE 102004002469 A1 8/2005
DE 102011088082 A1 6/2013
EP 0831278 A1 3/1998
EP 1076210 2/2001
EP 1079180 2/2001
EP 1081437 3/2001
EP 1291583 A2 3/2003
EP 1308676 A2 * 5/2003 ..... F24C 15/04
EP 1867927 12/2007
EP 2090832 8/2009
EP 2362150 A1 8/2011
EP 2634493 A1 9/2013
GB 2410325 A 7/2005
WO 2013083433 A1 6/2013
WO 2015062920 A1 5/2015

OTHER PUBLICATIONS

EP-1308676-A2—English machine translation.*
International Search Report & Written Opinion issued in corresponding PCT Application No. PCT/EP2015/059549 dated Jun. 15, 2015, 14 pages.
Office action issued in corresponding U.S. Appl. No. 14/916,759 dated Feb. 9, 2018, 23 pages.
Examination report issued in European Patent Application No. 14183706.2 dated Oct. 27, 2016, 8 pages.
Examination report issued in European Patent Application No. 13191089 dated Dec. 9, 2013, 6 pages.
International Search Report issued in PCT/EP2014/072585 dated Feb. 12, 2015, 3 pages.

* cited by examiner

GLASS PACKAGE AND FRAMEWORK FOR AN OVEN DOOR OF A COOKING OVEN

The present invention relates to a glass package for an oven door of a cooking oven. Further, the present invention relates to a framework for an oven door of a cooking oven. Moreover, the present invention relates to an oven door for a cooking oven. Additionally, the present invention relates to a method for assembling an oven door for a cooking oven.

The oven cavity of a cooking oven is usually closable by an oven door pivotally mounted at a chassis or front frame of said cooking oven. A conventional oven door includes an outer or a front panel having an outer or front surface, respectively. A central opening is arranged in an outer transparent panel. In addition to the outer transparent pane, the door can be provided with additional inner glass panes, gaskets, glass holders, silicon parts, door hinges, brackets for a door handle fixation and insulation panes. Thus, the door of the cooking oven includes usually a number of different components which have to be assembled together into a mechanical structure of the oven door.

The complexity of the oven door is very high and it takes a time to assembly such an oven door in assembly line, and an automatic door assembly is not possible as well. Furthermore, the oven door and its components should be cleaned by the user from time to time. However, it is difficult for the user to disassembly the oven door, clean each component and afterward to assembly all of these components together again and at the correct positions. Furthermore, if the mechanical structure of the oven door is realized by a number of different components, then the assembling and disassembling of the glass panes is very difficult, so that additional tools and/or components are required.

Additionally, the inner glass pane is always fixed with the mechanical structure of the oven door by means of a cover element overlapping with said inner glass pane or by means of two additional holding elements overlapping with the inner glass pane and connecting said inner glass pane to the mechanical structure of the oven door. Thus, all these cover elements and holding elements are visible from outside, are difficult to clean and could be damaged due to higher temperature coming out from the oven cavity.

It is an object of the present invention to provide a glass package and a corresponding framework for an oven door, which overcomes one or more of the drawbacks mentioned above.

The present invention provides a glass package for an oven door of a cooking oven, wherein

- the glass package includes an inner glass pane and at least one further glass pane,
- the inner glass pane is provided for an arrangement towards to an oven cavity in an assembled and a closed state of the oven door, while the at least one further glass pane is provided for an arrangement opposite to the oven cavity in the assembled and closed state of the said door,
- the glass package includes connecting means for a permanent connection between the inner glass pane and the at least one further glass pane,
- the inner glass pane and the at least one further glass pane are arranged plane-parallel to each other,
- an intermediate space is formed between two adjacent glass panes,
- at least one slot and/or channel enclose or encloses at least partially the circumferential sides of the glass package along a circumferential direction,

- the width and height of the inner glass pane are bigger than the width and height, respectively, of the at least one further glass pane and of any further component of the glass package, and
- the widths and heights of the glass panes relate to the large-area sides of said glass panes.

The core of the present invention is that the biggest width and/or height of the glass package are/is defined by the inner glass pane on the one hand and the permanent connection between the glass panes of the glass package on the other hand. Thus, the at least one slot and/or channel are/is arranged in the circumferential environment of the at least one further glass pane, since the inner glass pane is the widest and/or highest component of the glass pane. When the glass package is inserted in a receiving part, then an outer portion of the outer side of the inner glass pane is aligned at said receiving part, while the slot, the channel and/or an edge of the further glass pane interacts with fastening means of the receiving part.

In particular, the at least one slot and/or channel are/is arranged at two or more opposite circumferential sides of the glass package.

For example, the connecting means include at least one elongated gasket enclosing at least partially an inner intermediate space between two adjacent glass panes, wherein the at least one slot encloses an outer circumferential side of said gasket and extends along the circumferential direction of the glass package.

In this case, the gasket may include at least one gluing strip or is formed as a gluing strip.

According to another example, the connecting means include at least one spacer enclosing at least partially the inner intermediate space between two adjacent glass panes, wherein the at least one slot encloses an outer circumferential side of said spacer and extends along the circumferential direction of the glass package.

Preferably, the at least one spacer is glued at the glass panes. For example, the spacer may be fastened at the glass panes by a gluing strip.

Additionally, the spacer may include at least one channel extending at least partially along an outer circumferential side of said spacer along a circumferential direction of the glass package. In this case the channel extends the cross-section of the slot.

According to a further embodiment, the connecting means include at least one frame enclosing at least partially the at least one further glass pane, wherein the at least one channel is formed at an outer circumferential side of said frame and extends along the circumferential direction of the glass package.

In particular, the spacer or the frame is made of at least one plastic material and/or at least one metal material. For example, the spacer or the frame is formed as an extrusion profile, a moulded profile or metal formed profile.

The present invention relates further to a framework for an oven door of a cooking oven, wherein

- the framework includes a front panel and a door frame,
- the door frame is permanently attached at an inner side of the front panel, wherein said inner side is provided for an arrangement towards to an oven cavity in an assembled and a closed state of the oven door,
- the door frame encloses at least partially an inner portion of the framework,
- the door frame is provided for receiving a glass package including an inner glass pane and at least one further glass pane, the door frame includes fastening means at its inner circumferential sides, the fastening means are provided for interacting with one or more of the at least one further glass pane, and the inner glass pane of the glass package is provided to be aligned at an inner side of the door frame, wherein said inner side of the door frame is provided for an arrangement towards to an oven cavity in the assembled and closed state of the oven door.

The framework is adapted for receiving a glass package. In particular, the door frame of said framework is provided for receiving the glass package mentioned above.

Preferably, the fastening means include at least one lug element, wherein said lug element and an edge of one of the at least one further glass pane are provided to form a snap-in mechanism, and/or wherein said lug element and the at least one slot and/or channel of the glass package are provided to form a snap-in mechanism.

Alternatively or additionally, the fastening means include at least one frame channel, wherein said frame channel is provided to enclose circumferentially one of the at least one further glass pane.

Moreover, the present invention relates to an oven door for a cooking oven, wherein the oven door comprises a glass package and a framework mentioned above, wherein a door frame of the framework is provided for receiving the glass package.

In particular, the width and height of the inner glass pane are at least as big as the width and height, respectively, of the door frame of the framework.

Additionally, the present invention relates to a method for assembling an oven door for a cooking oven mentioned above, said method comprises the following steps:

providing at least two glass panes, providing connecting means for the glass panes, permanent assembling of the at least two glass panes to a glass package by the connecting means, so that the at least two glass panes are arranged plane-parallel to each other and the width and height of an inner glass pane is bigger than the width and height, respectively, of the at least one further glass pane, wherein said inner glass pane is provided for an arrangement towards to an oven cavity in an assembled and a closed state of the oven door, while the at least one further glass pane is provided for an arrangement opposite to the oven cavity in the assembled and closed state of the said door, providing a framework including a front panel and a door frame attached permanently at an inner side of said front panel, wherein said inner side is provided for an arrangement towards to the oven cavity in the assembled and closed state of the oven door, inserting the glass package into the door frame of the framework, connecting the glass package with the framework, wherein one or more of the at least one further glass pane interacts with fastening means arranged at an inner circumferential side of the door frame, so that the inner glass pane is aligned at an inner side of said door frame, and wherein said inner side of the door frame is provided for an arrangement towards to the oven cavity in the assembled and closed state of the oven door.

The inventive method allows an easy assembling of the oven door. The glass package and the framework are removably connected to each other, so that the user can easily remove the glass package from the framework.

Novel and inventive features of the present invention are set forth in the appended claims.

Figure 2:
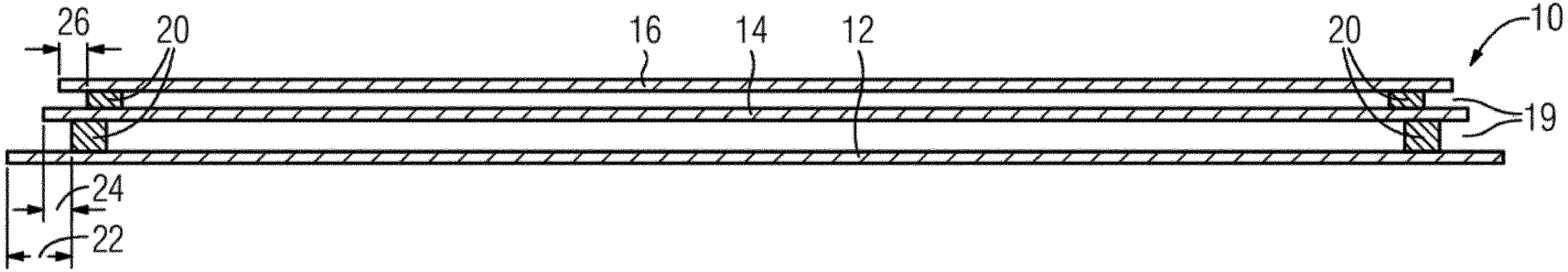
Figure 3:
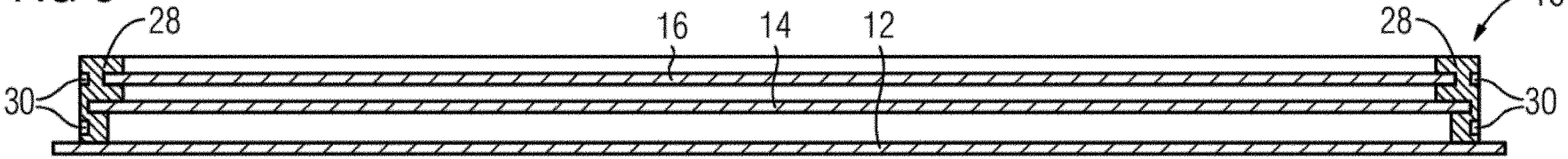
Figure 4:
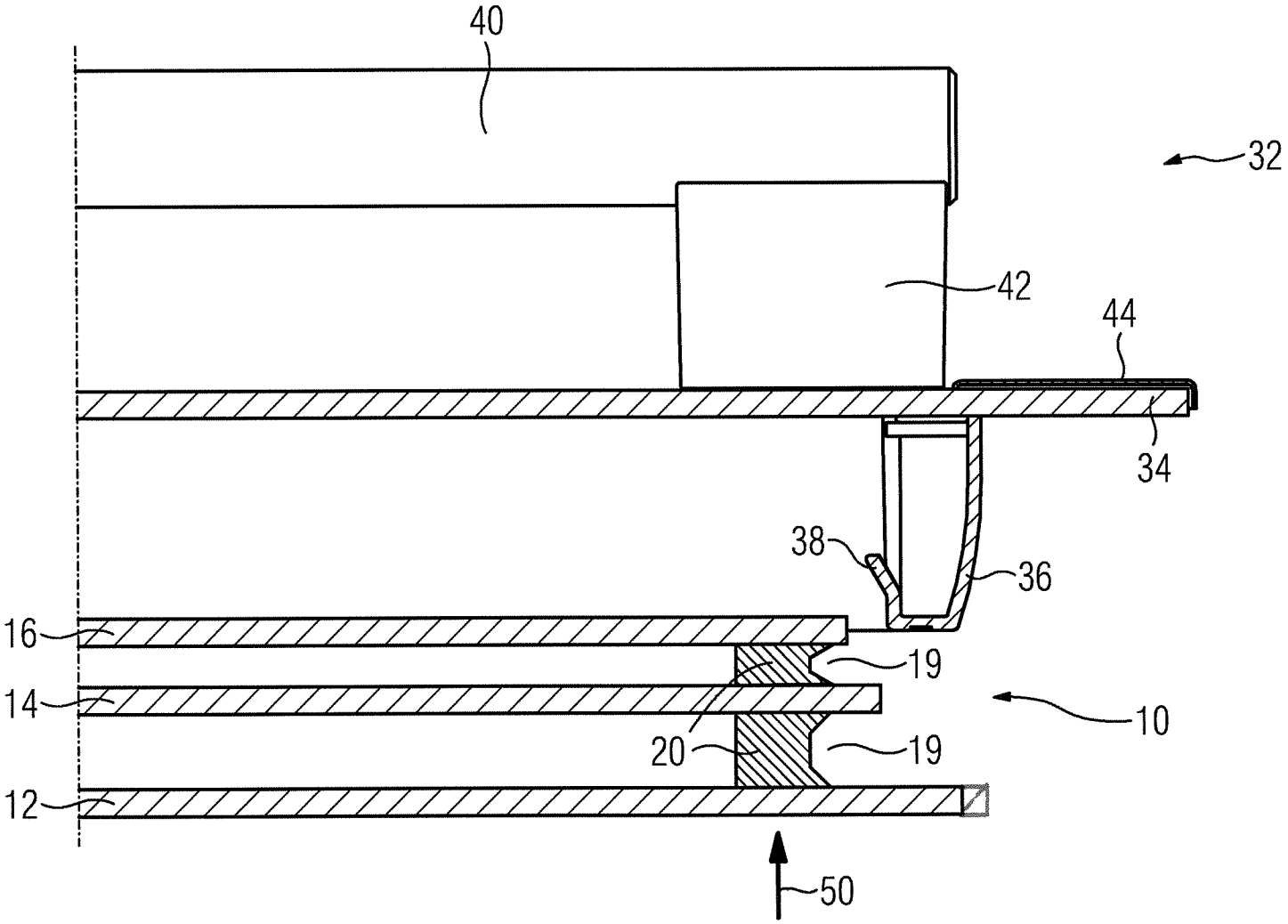
Figure 5:
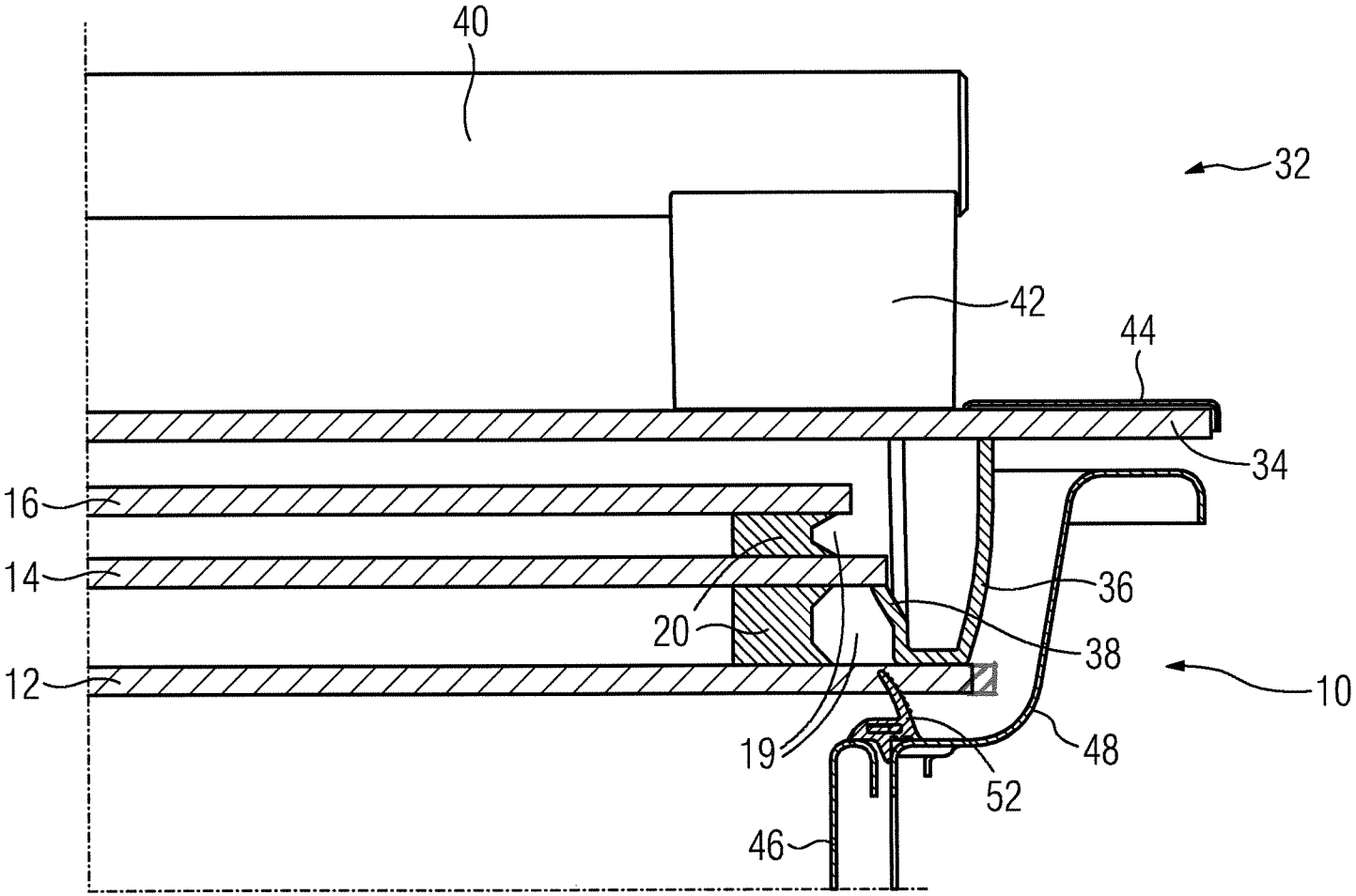
Figure 6:
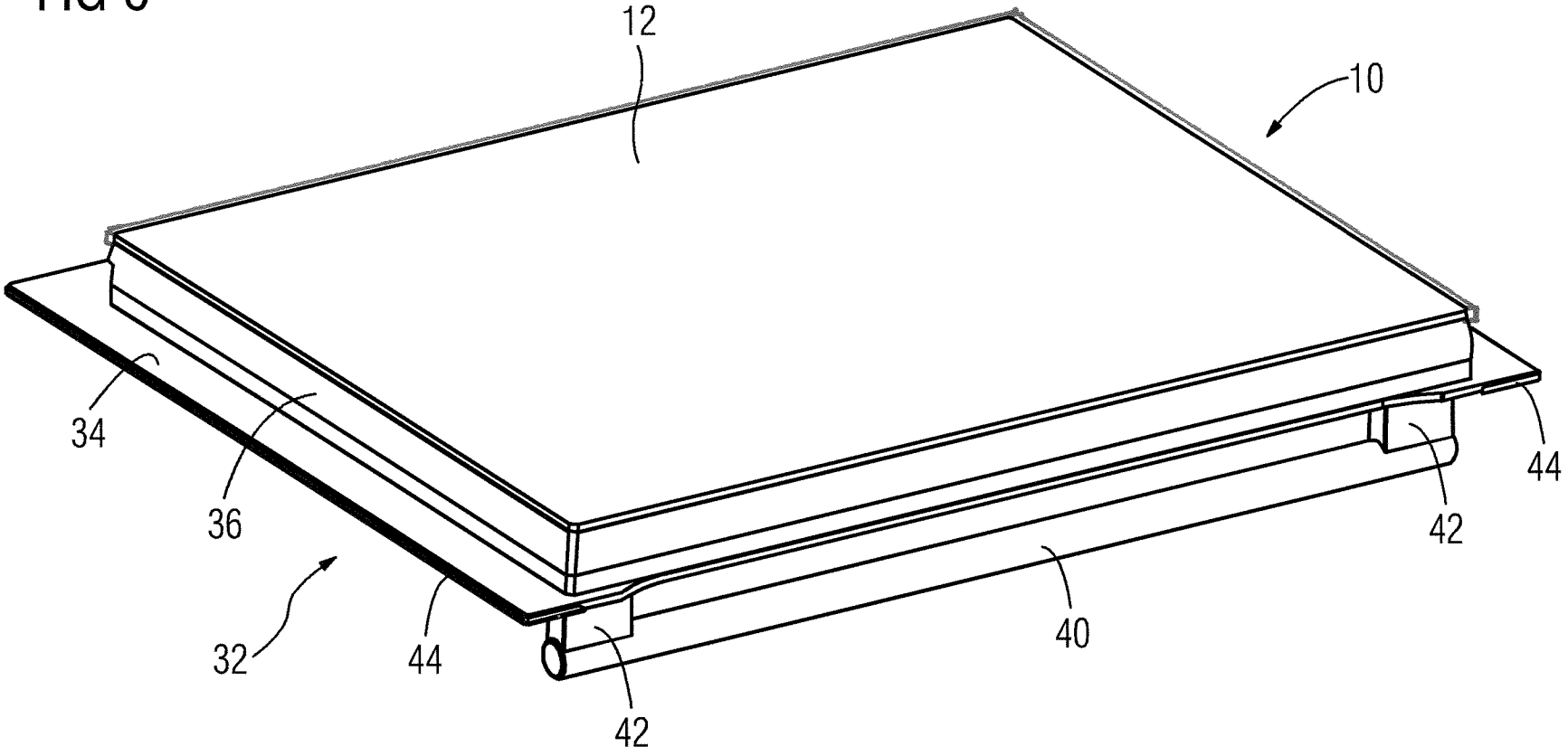
Figure 7:
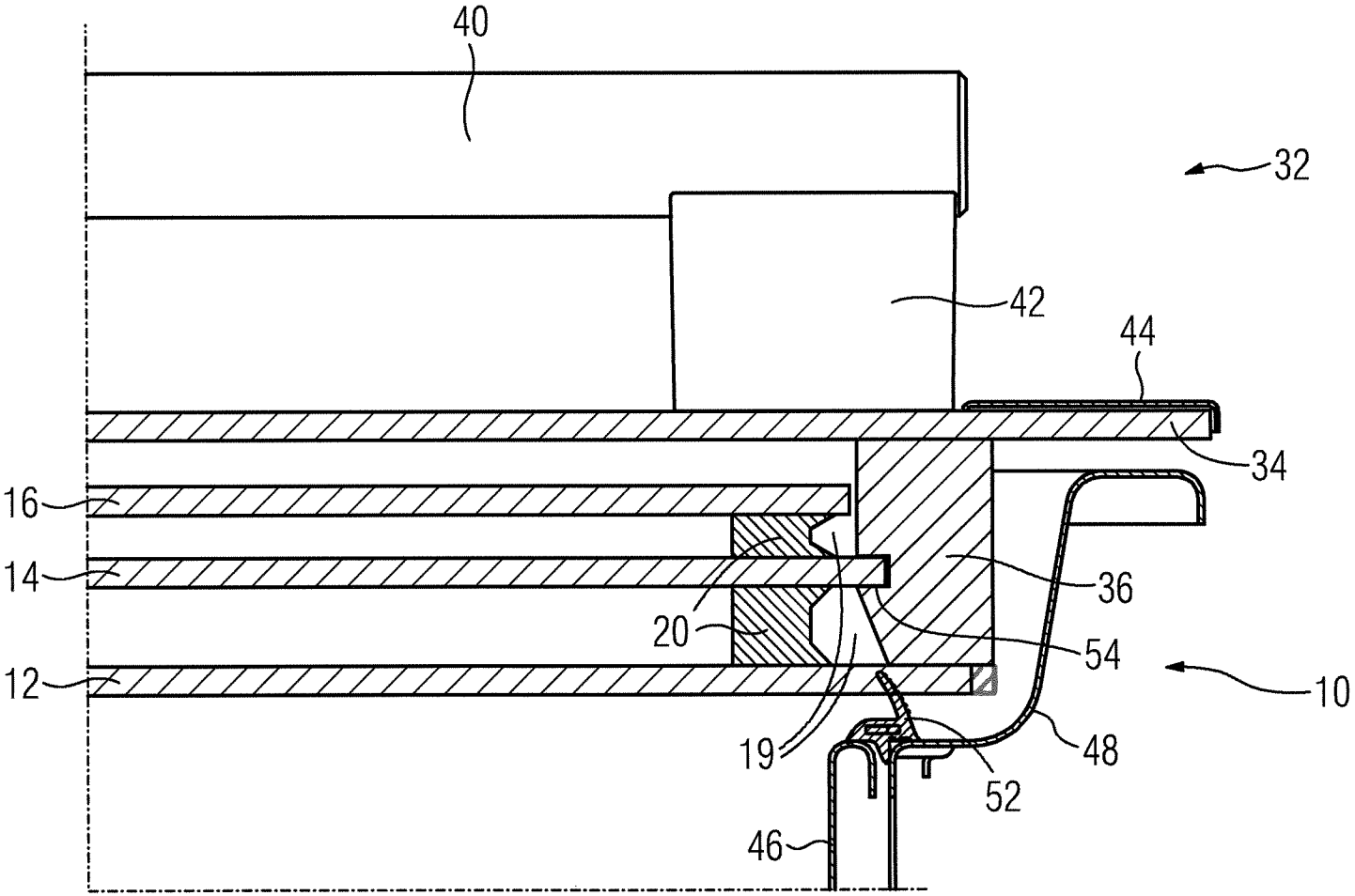

The present invention will be described in further detail with reference to the drawing, in which FIG. 1 illustrates a schematic sectional top view of a glass package for an oven door according to a first embodiment of the present invention, FIG. 2 illustrates a schematic sectional top view of the glass package for the oven door according to a second embodiment of the present invention, FIG. 3 illustrates a schematic sectional top view of the glass package for the oven door according to a third embodiment of the present invention, FIG. 4 illustrates a schematic partial sectional top view of the oven door according to a preferred embodiment of the present invention, wherein said oven door is in a state before being assembled, FIG. 5 illustrates a schematic partial sectional top view of the oven door, an oven cavity and a front frame according to the preferred embodiment of the present invention, wherein the oven door is in an assembled and a closed state, FIG. 6 illustrates a schematic perspective view of the oven door according to the preferred embodiment of the present invention, and FIG. 7 illustrates a schematic partial sectional top view of the oven door, the oven cavity and the front frame according to a further embodiment of the present invention, wherein the glass package is in a mounted state at said oven door.

FIG. 1 illustrates a schematic sectional top view of a glass package 10 for an oven door according to a first embodiment of the present invention. The glass package 10 includes three glass panes 12, 14 and 16 arranged plane-parallel to each other. In general, the glass package 10 includes at least two glass panes.

The glass package 10 includes an inner glass pane 12, an intermediate glass pane 14 and an outer glass pane 16. In an assembled state of the glass package 10 at the oven door and in a closed state of said oven door, the inner glass pane 12 is arranged closer to an oven cavity than the intermediate glass pane 14 and again the intermediate glass pane 14 is arranged closer to the oven cavity than the outer glass pane 16. The inner glass pane 12 is marginally bigger than the intermediate glass pane 14. In turn, the intermediate glass pane 14 is marginally bigger than the outer glass pane 16.

In this example, the thicknesses of the outer glass pane 12, the intermediate glass pane 14 and the inner glass pane 16 are substantially equal. Further, the distance between the inner glass pane 12 and the intermediate glass pane 14 is bigger than the distance between the intermediate glass pane 14 and the outer glass pane 16 in the embodiment of FIG. 1. In this example, the distance between the outer glass pane 12 and the intermediate glass pane 14 is substantially the same as the thicknesses of the glass panes 12, 14 and 16.

The adjacent glass panes 12, 14 and 16 are fixed together by gaskets 18. The inner glass pane 12 and intermediate glass pane 14 are fixed together by at least one gasket 18. In a similar way, the intermediate glass pane 14 and the outer glass pane 16 are fixed together by at least one further gasket 18. The gaskets 18 extend along an outer portion of the intermediate space between the adjacent glass panes 12, 14 and 16. The gaskets 18 enclose an inner intermediate space between the adjacent glass panes 12, 14 and 16. Further, the gaskets 18 are spaced apart from the edges of the glass panes 12, 14 and 16. The distances between the gaskets 18 and the adjacent edges of the glass panes 12, 14 and 16 are about the same as the distances between the adjacent glass panes 12, 14 and 16. For example, the gasket 18 may be a glue silicone strip.

For example, the inner intermediate space enclosed by at least one gasket 18 is hermetic closed, so that no air flow occurs in said inner intermediate space. Alternatively, the inner intermediate space may be formed as an open space. The hermetic closed inner intermediate space between two adjacent glass panes 12, 14 and 16, in particular between the inner glass pane 12 and intermediate glass pane 14, is advantageous in view of energy consumption. In contrast, the open inner intermediate space between the adjacent glass panes 12, 14 and 16, in particular between the intermediate glass pane 14 and outer glass pane 16, allows a lower temperature at a front side of the oven door. Further, the hermetic closed inner intermediate space may be vacuum-sealed or filled with inert gas.

The glass package 10 is circumferentially enclosed by two slots 19. The slots 19 are formed in an outer intermediate space between two adjacent glass panes 12, 14 and 16. Since the gaskets 18 are spaced apart from the edges of the glass panes 12, 14 and 16, the slots 19 are formed by the outer portions of two opposite surfaces of the adjacent glass panes 12, 14 and 16 and by the outer circumferential sides of the gaskets 18. The side walls of each slot 19 are formed by the outer portions of two opposite surfaces of the adjacent glass panes 12, 14 and 16. The bottom wall of each slot 19 is formed by the outer circumferential side of the gasket 18. In other words, the intermediate space between two adjacent glass panes 12, 14 and 16 is separated into the inner and outer intermediate space by the at least one gasket 18, wherein the at least one gasket 18 encloses at least partially the inner intermediate space, while the outer intermediate space forms the slot 19.

FIG. 2 illustrates a schematic sectional top view of the glass package 10 for an oven door according to a second embodiment of the present invention. The glass package 10 of the second embodiment includes also the inner glass pane 12, the intermediate glass pane 14 and the outer glass pane 16. The inner glass pane 12, the intermediate glass pane 14 and the outer glass pane 16 of the second embodiment have the same geometric relationships as those of the first embodiment. The distances between the glass panes 12, 14 and 16 of the first and second embodiments are substantially the same.

Instead of the gaskets 18 of the first embodiment, the glass package 10 according to the second embodiment includes spacers 20 between the adjacent glass panes 12, 14 and 16. The spacers 20 allow also a hermetic closed inner intermediate space as well as an open inner intermediate space between two of the adjacent panes 12, 14 and 16. The hermetic closed inner intermediate space may be vacuum-sealed or filled with inert gas. Further, the spacers 20 are spaced apart from the edges of the glass panes 12, 14 and 16. The distance between the spacers 20 and the adjacent edges of the glass panes 12, 14 and 16 are about the same as the distances between the adjacent glass panes 12, 14 and 16. The spacers 20 may be glued onto the glass panes 12, 14 and 16.

The glass package 10 of the second embodiment is also circumferentially enclosed by two slots 19 formed in the outer intermediate space between two adjacent glass panes 12, 14 and 16. Since the spacers 20 are spaced apart from the edges of the glass panes 12, 14 and 16, the slots 19 are formed by the outer portions of two opposite surfaces of the adjacent glass panes 12, 14 and 16 and by the outer circumferential sides of the spacers 20. The side walls of each slot 19 are formed by the outer portions of two opposite surfaces of the adjacent glass panes 12, 14 and 16, while the bottom wall of each slot 19 is formed by the outer circumferential side of the spacer 20. Additionally, the spacer 20 may include a channel at its outer circumferential side, so that the cross-section of the slot 19 is extended by the cross-section of said channel.

An inner side distance 22 is defined between an outer circumferential edge of the inner glass pane 12 and the spacer 20 between said inner glass pane 12 and the intermediate glass pane 14. In a similar way, an intermediate side distance 24 is defined between an outer circumferential edge of the intermediate glass pane 14 and the spacer 20 between the inner glass pane 12 and the intermediate glass pane 14. Further, an outer side distance 26 is defined between an outer circumferential edge of the outer glass pane 16 and the spacer 20 between said outer glass pane 16 and the intermediate glass pane 14. Said side distances 22, 24 and 26 correspond with the depths of one of the side walls of the slots 19. Preferably, the inner side distance 22, the intermediate side distance 24 and the outer side distance 26 are between 2 mm and 20 mm.

FIG. 3 illustrates a schematic sectional top view of the glass package 10 for an oven door according to a third embodiment of the present invention. The glass package 10 of the third embodiment includes also the inner glass pane 12, the intermediate glass pane 14 and the outer glass pane 16. The inner glass pane 12, the intermediate glass pane 14 and the outer glass pane 16 of the third embodiment have the same geometric relationships as those of the first and second embodiments. The distances between the glass panes 12, 14 and 16 of the first, second and third embodiments are substantially the same.

Instead of the gaskets 18 and spacers 20 of the first and second embodiments, respectively, the glass package 10 according to the third embodiment includes a frame 28 aligned at an outer side of the inner glass pane 12 and enclosing the intermediate glass pane 14 and outer glass pane 16. The outer side of the inner glass pane 12 is defined as the side opposite to the oven cavity in the mounted state. The frame 28 may be formed as a single-piece part or may include several frame parts. The circumferential side or sides of the further glass panes 14 and 16 may be overmoulded by the frame 28. Alternatively, the frame 28 may be disassembled from the glass panes 12, 14 and 16.

The frame 28 allows also a hermetic closed inner intermediate space as well as an open inner intermediate space between adjacent panes 12, 14 and 16. Moreover, the hermetic closed inner intermediate space may be vacuum-sealed or filled with inert gas.

The glass package 10 of the third embodiment is circumferentially enclosed by two channels 30. The channels 30 are formed in an outer circumferential side of the frame 28. The channels 30 enclose at least partially the frame 28 along its circumferential sides.

FIG. 4 illustrates a schematic partial sectional top view of an oven door according to a preferred embodiment of the present invention, wherein said oven door is in a state before being assembled. The oven door comprises a framework 32 and the glass package 10. In this example, the oven door comprises the glass package 10 according to the second embodiment. Further, the oven door is also suitable for the glass packages 10 according to the first and third embodiments.

The framework 32 includes a front panel 34, a door frame 36, a door handle 40, fasting elements 42 for said door handle 40 and at least one front cover 44. The door frame 36 is permanently attached at an inner side of the front panel 34. The inner side of the front panel 34 is defined as the side towards to the oven cavity in the mounted and closed states of the oven door. The door handle 40 is attached at an outer side of the front panel 34 by the fasting elements 42. The outer side of the front panel 34 is defined as the side opposite to the oven cavity in the mounted and closed states of the oven door. In this example, the door handle 40 is attached at the outer side of the front panel 34 by two fasting elements 42, wherein said fasting elements 42 are arranged at the end portion of the elongated door handle 40. The front cover 44 is also attached at the outer side of the front panel 34 and covers partially the outer side of said front panel 34.

The door frame 36 is provided for receiving the glass package 10, so that the door frame 36 encloses at least partially said glass package 10. The glass package 10 is partially inserted into the door frame 36 by a movement perpendicular to the plane of the glass package 10 and the front panel 34 of the framework 32. The direction of movement of the glass package 10 relative to the framework 32 is represented by an arrow 50.

The door frame 36 includes one or more lug elements 38 arranged at an inner circumferential side of said door frame 36. The lug element 38 interacts with an inner edge of the intermediate pane 14. The inner edge of the intermediate pane 14 is defined as the edge towards to the oven cavity in the mounted and closed states of the oven door. The lug element 38 and the inner edge of the intermediate pane 14 form a snap-in mechanism. In this example, the door frame 36 is similar as an L-shaped or a G-shaped profile part.

The width and height of the inner glass pane 12 are at least as big as the width and height, respectively, of the door frame 36 of the framework 32. Thus, the inner glass pane 12 covers completely the door frame 36 of the framework 32.

FIG. 5 illustrates a schematic partial sectional top view of the oven door according to the preferred embodiment of the present invention, wherein the oven door is in an assembled and a closed state.

In the assembled state of the oven door, the glass package 10 is received by the door frame 36 of the framework 34. The lug element 38 interacts with the inner edge of the intermediate pane 14. The lug element 38 is aligned at an inner side of the intermediate pane 14. The inner side of the intermediate pane 14 is defined as the side towards to the oven cavity in the mounted and closed states of the oven door. Further, an inner side of the door frame 36 is aligned at an outer side of the inner glass pane 12. The inner side of the door frame 36 is defined as the side towards to the oven cavity in the mounted and closed states of the oven door. The outer side of the inner glass pane 12 is defined as the side opposite to the oven cavity in the mounted and closed states of the oven door. Thus, a part of the door frame 36 is stably received by the slot 19 between the inner glass pane 12 and intermediate glass pane 14, wherein said part of the door frame 36 includes the lug element 38.

In FIG. 5 the oven door is in an assembled and a closed state. The oven door is arranged at a cooking oven including the oven cavity 46 and a front frame 48. The front frame 48 of the cooking oven encloses the oven cavity 46. A door gasket 52 is provided for filling a gap between the oven cavity 46 and the front frame 48. Further, the door gasket 52 is provided for filling a gap between the oven door at the one side and the oven cavity 46 and the front frame 48 on the other side.

FIG. 6 illustrates a schematic perspective view of the oven door according to the preferred embodiment of the present invention.

The oven door is assembled, i.e. the glass package 10 is received by the door frame 36 of the framework 34. The door frame 36 is attached at an inner side of the front panel 34. The door handle 40 is attached at the outer side of the front panel 34 by the two fasting elements 42. In this example, the fasting elements 42 are arranged at the end portions of the elongated door handle 40. The at least one front cover 44 is also attached at the outer side of the front panel 34 and covers partially the outer side of said front panel 34. In this example, two front covers 44 are attached at the outer side of the front panel 34, wherein each front cover 44 covers a lateral portion of the outer side of the front panel 34.

The width and height of the inner glass pane 12 are at least as big as the width and height, respectively, of the door frame 36 of the framework 32, so that the inner glass pane 12 covers completely the door frame 36 of the framework 32.

FIG. 7 illustrates a schematic partial sectional top view of the oven door according to a further embodiment of the present invention, wherein the oven door is in an assembled and a closed state. The further embodiment in FIG. 7 is similar to the preferred embodiment in FIG. 5.

While the door frame 36 in FIG. 5 is similar as an L-shaped or a G-shaped profile part, the door frame 36 in FIG. 7 is formed as at least one solid part. Said door frame 36 is permanently attached at an inner side of the front panel 34. Instead of the lug element 38, the door frame 36 includes a frame channel 54. The frame channel 54 receives the outer circumferential portion of the intermediate glass pane 14. The oven door may be assembled by moving the glass package 10 plane-parallel to the front panel 34 of the framework 32, wherein the glass package 10 is moved along the longitudinal axes of the frame channel 54 and of the corresponding edge of the glass pane 14.

The width and height of the inner glass pane 12 are at least as big as the width and height, respectively, of the door frame 36 of the framework 32. Thus, also the inner glass pane 12 of the further embodiment covers completely the door frame 36 of the framework 32.

The present invention provides the glass package 10 and the framework 32 for the oven door, which allows simple manufacturing of the oven door by low costs. The glass package 10 can be at first preassembled and then inserted into the framework of the oven door. The structure of the glass package 10 allows an automatic preassembling of said glass package 10. Further, the structures of the glass package 10 and the framework 32 allow automatic assembling of the oven door by inserting the glass package 10 into the framework 32. Moreover, the present invention allows an easy disassembling of the oven door.

The present invention allows different kinds of glass packages 10. Said kinds of glass packages 10 may include different numbers of glass panes 12, 14 and 16. For example, two, three or four glass panes are possible. Further, glass packages 10 with different intermediate spaces are also possible. Moreover, different positions of the spacers 20 related to the oven cavity 46 are possible. Therefore, the gaskets 18, the spacers 20 and/or the gluing strip may be arranged in the area of the glass package 10. Additionally, the present invention avoids visible holding elements for the glass package 10. At last, the inventive oven door is easy to clean.

Although illustrative embodiments of the present invention have been described herein with reference to the accompanying drawing, it is to be understood that the present invention is not limited to those precise embodiments, and that various other changes and modifications may be affected therein by one skilled in the art without departing from the scope or spirit of the invention. All such changes and modifications are intended to be included within the scope of the invention as defined by the appended claims.

LIST OF REFERENCE NUMERALS

10 glass package
12 inner glass pane
14 intermediate glass pane
16 outer glass pane
18 gasket
19 slot
20 spacer
22 inner side distance
24 intermediate side distance
26 outer side distance
28 frame
30 channel
32 framework
34 front panel
36 door frame
38 lug element
40 door handle
42 fastening element
44 front cover
46 oven cavity
48 front frame
50 assembling direction
52 oven gasket
54 frame channel

The invention claimed is:

1. An oven door for a cooking oven comprising a framework and a glass package;

the glass package comprising a first, inner glass pane and a second glass pane disposed plane-parallel and permanently connected to the first glass pane so as to define an intermediate space between said first and second glass panes that is hermetically sealed such that no air flow passes therethrough, and a slot extending along a circumferential side of the glass package, said first glass pane having width and height dimensions greater than any other element of the glass package;

the framework comprising a door frame configured to receive the glass package, the door frame having a fastener disposed at and extending along an inner circumferential side thereof such that in an assembled state of said door said fastener circumferentially encloses and cooperates with said second glass pane of said glass package to secure the glass package to the door frame;

said glass package being preassembled independently of said framework and then fastened to said door frame of said framework such that in the assembled state of said door no fasteners for securing the glass package to the framework are visible from outside of the door.

2. The oven door of claim 1, said first and second glass panes being permanently connected to one another via an elongate gasket or spacer that extends circumferentially about and defines an outer portion of the intermediate space between said first and second panes, said gasket or spacer being spaced apart from edges of said first and second panes to thereby define said slot between opposing surfaces of said first and second panes and a surface of said gasket or spacer facing away from said intermediate space, said fastener being a lug element that together with the edge of said second glass pane forms a snap-in mechanism that secures the glass package to the framework as the glass package is pressed into the door frame along a direction perpendicular to planes of the first and second glass panes to yield the assembled condition of the door.

3. The oven door of claim 1, said first and second glass panes being permanently connected to one another via a frame that at least partially circumferentially encloses the second glass pane and which extends circumferentially about and defines an outer portion of the intermediate space between said first and second panes, said slot being a channel that is formed in and extends along an outer circumferential side of said frame facing away from said intermediate space, said fastener being a lug element that together with said channel forms a snap-in mechanism that secures the glass package to the framework as the glass package is pressed into the door frame along a direction perpendicular to planes of the first and second glass panes to yield the assembled condition of the door.

4. A glass package for an oven door of a cooking oven, wherein:

the glass package includes an inner glass pane and at least one further glass pane, the inner glass pane is provided for an arrangement towards an oven cavity in an assembled and a closed state of the oven door, while the at least one further glass pane is provided for an arrangement opposite to the oven cavity in the assembled and closed state of the said door, the glass package includes connecting means for a permanent connection between the inner glass pane and the at least one further glass pane, the inner glass pane and the at least one further glass pane are arranged plane-parallel to each other, an intermediate space is formed between two adjacent glass panes, at least one slot and/or channel enclose or encloses at least partially the circumferential sides of the glass package along a circumferential direction, the width and height of the inner glass pane are bigger than the width and height, respectively, of the at least one further glass pane and of any further component of the glass package, the widths and heights of the glass panes relate to the large-area sides of said glass panes, the connecting means include at least one spacer enclosing at least partially the intermediate space between two adjacent glass panes, wherein the at least one slot encloses an outer circumferential side of said spacer and extends along the circumferential direction of the glass package, and wherein the spacer is spaced apart from edges of said inner glass pane and the at least one further glass pane, and the spacer includes at least one channel extending at least partially along an outer circumferential side of said spacer along a circumferential direction of the glass package.

5. The glass package according to claim 4, wherein the at least one slot and/or channel are/is arranged at two or more opposite circumferential sides of the glass package.

6. The glass package according to claim 4, wherein the spacer is glued at the glass panes.

7. The glass package according to claim 6, wherein the spacer is made of at least one plastic material and/or at least one metal material.

8. An oven door for a cooking oven, said oven door comprising a glass package and a framework, wherein:

the glass package includes an inner glass pane and at least one further glass pane, the inner glass pane is provided for an arrangement towards an oven cavity in an assembled and a closed state of the oven door, while the at least one further glass pane is provided for an arrangement opposite to the oven cavity in the assembled and closed state of the said door, the inner glass pane and the at least one further glass pane are arranged plane-parallel to each other, an intermediate space is formed between two adjacent glass panes, at least one slot and/or channel enclose or encloses at least partially circumferential sides of the glass package along a circumferential direction, a width and a height of the inner glass pane are bigger than a width and a height, respectively, of the at least one further glass pane and of any further component of the glass package, wherein said widths and heights of the glass panes relate to large-area sides of said glass panes, the framework includes a front panel and a door frame, the door frame is permanently attached at an inner side of the front panel, wherein said inner side is provided for an arrangement towards the oven cavity in the assembled and a closed state of the oven door, the door frame encloses at least partially an inner portion of the framework, the door frame is provided for receiving the glass package, the door frame includes fastening means at its inner circumferential sides, wherein the fastening means are provided for interacting with one or more of the at least one further glass pane, the inner glass pane of the glass package is provided to be aligned at an inner side of the door frame, wherein said inner side of the door frame is provided for an arrangement towards said oven cavity in the assembled and closed state of the oven door, the fastening means include at least one lug element, wherein said lug element and an edge of one of the at least one further glass pane are provided to form a snap-in mechanism, and/or wherein said lug element and the at least one slot and/or channel of the glass package are provided to form a snap-in mechanism, and the fastening means include at least one frame channel provided to enclose circumferentially one of the at least one further glass pane.

9. A method for assembling the oven door for a cooking oven according to claim 8, said method comprises the following steps:

providing the inner glass pane and the at least one further glass pane, providing connecting means for the inner glass pane and the at least one further glass pane, permanent assembling of the inner glass pane and the at least one further glass pane to the glass package by the connecting means, providing the framework including the front panel and the door frame attached permanently at the inner side of said front panel, inserting the glass package into the door frame of the framework, connecting the glass package with the framework, wherein one or more of the at least one further glass pane interacts with the fastening means, so that the inner glass pane is aligned at the inner side of said door frame.

* * * * *